US006988905B2

(12) United States Patent
Corey et al.

(10) Patent No.: US 6,988,905 B2
(45) Date of Patent: Jan. 24, 2006

(54) AUDIO JACK WITH PLUG OR HEAD SET IDENTIFICATION CIRCUIT

(75) Inventors: John Frederick Corey, Auckland (NZ); Mark Donaldson, Auckland (NZ)

(73) Assignee: Slab DSP Limited, Auckland (NZ)

( * ) Notice: Subject to any disclaimer, the term of this patent is extended or adjusted under 35 U.S.C. 154(b) by 0 days.

(21) Appl. No.: 10/326,581

(22) Filed: Dec. 20, 2002

(65) Prior Publication Data

US 2003/0153205 A1 Aug. 14, 2003

(51) Int. Cl.
*H01R 27/00* (2006.01)
*H04R 1/10* (2006.01)

(52) U.S. Cl. ..... 439/222; 439/669; 439/955; 381/74

(58) Field of Classification Search ..... 439/221, 439/222, 218, 668, 669, 955; 381/1, 74
See application file for complete search history.

(56) References Cited

U.S. PATENT DOCUMENTS 1,157,026 A * 10/1915 Meschenmoser ..... 439/252
4,433,209 A * 2/1984 Kurosawa et al. ..... 381/1
5,341,254 A * 8/1994 Ueno ..... 360/62
5,642,424 A * 6/1997 Masaki ..... 381/309
5,655,025 A * 8/1997 Kim et al. ..... 381/11
6,069,960 A * 5/2000 Mizukami et al. ..... 381/74
6,109,797 A * 8/2000 Nagura et al. ..... 385/88
6,594,366 B1 * 7/2003 Adams ..... 381/74

* cited by examiner

*Primary Examiner*—Neil Abrams
(74) *Attorney, Agent, or Firm*—Brouse McDowell; Daniel A. Thomson

(57) ABSTRACT

A jack (90) typically mounted in an aircraft seat is adapted for use with a variety of headset types. A jack has sockets (92, 93, 94) accepting any of several different types of plugs associated with different types of noise cancellation headsets or aviation industry headsets including one, two, or three pin types. The jack includes sensing components to correctly detect from the number of pins inserted, and the impedance and/or voltages sensed on those pins, the type of headset being used. With this identification, appropriate connections to the audio source as well as to noise cancellation circuitry may be made to enable the headset to function correctly

22 Claims, 6 Drawing Sheets

AUDIO JACK WITH PLUG OR HEAD SET IDENTIFICATION CIRCUIT

FIELD OF THE INVENTION

This invention relates to audio jacks and is directed particularly, but not solely, toward a multifunctional headphone jack for use with noise cancellation systems including noise cancellation headsets in passenger vehicles such as commercial aircraft.

BACKGROUND OF THE INVENTION

Passenger vehicles, particularly commercial aircraft, have seat installations which include jacks i.e. sockets for receiving connector plugs for headsets or headphones. Thus a user can provide his or her own headset, or be provided with a headset by an attendant on the vehicle and can plug the headset into the jack provided on the relevant seat to listen to various audio channels.

Typically, the audio information is provided in the form of an electric signal that is passed by electric connections between the jack and the plug to the headset.

Recent developments to passenger audio systems include noise reduction headphones. There have been many attempts to create noise reduction headphones for use onboard commercial passenger aircraft. There are presently several embodiments of noise reduction systems, and most have their own particular headset plug and jack arrangement.

For example, in one noise reduction system there is an electronic circuit providing noise reduction functionality located in a medallion at arms length and separate to the headphone. The headphone must interface to the noise reduction circuit via a connector and jack of some description. One such connector comprises a standard 3.5 mm stereo plug in combination with a 2.5 mm stereo plug providing six potential signal lines.

In another example, the electronic circuit providing noise reduction functionality is located within or adjacent to the headphone i.e. as an adjunct to the headphones. This circuit may require power and therefore a connector providing stereo audio and power is necessary. One such connector uses a three prong configuration (i.e. three pins from the plug) comprising two 3.5 mm mono plugs in combination with a single 2.5 mm mono plug. This provides the capacity for six independent signal lines, of which four independent signal lines are typically used.

In all cases the use of the three prong jack to enable connection of a headphone with adjunct circuit removes the possibility of easily deploying an alternative system such as that where the noise reduction circuit is located at arms length to the headphone and vice versa. This is because the different plug and jack arrangements mean that to switch from one system to another means changing the jack and associated cabling. Therefore, variations in jack configuration create an unnecessary barrier for the operator to frequently change or upgrade the way in which active noise reduction and audio in general is delivered to passengers via headphones. The other disadvantage with the variations in jack configuration is that it makes it cumbersome to interconnect variations of similar technology, which require, in most cases, the same signal lines to operate.

OBJECT OF THE INVENTION

It is an object of the present invention to provide an improved audio jack or an audio jack with a plug or headset identification circuit. Alternatively, it is an object of the invention to at least provide the public with a useful choice.

SUMMARY OF THE INVENTION

Accordingly in one aspect the invention may broadly be said to consist in an audio jack having plug receiving means for receiving one of a plurality of different audio plugs, each plug having one or more pins, and interface means to enable the jack to identify the equipment attached to the plug.

Preferably the interface means comprise a passive or active electric circuit for identifying the configuration of the plug and/or the contact arrangement of the plug.

Preferably the circuit enables correct electrical connection between an audio source and the plug contacts to be made.

Accordingly in another aspect the invention may broadly be said to consist in an audio jack having plug receiving means for receiving one of a plurality of different audio plugs, each plug having one or more pins, and identification means to enable the jack to identify equipment attached to the plug.

Preferably the identification means identify headset requirements from the plug type and/or the contact arrangement of the plug.

Preferably the headset contains only headphones and the identification means includes an active and/or passive network for providing an interface between the headphones and an audio signal source and the network operates in conjunction with the electric circuit to correctly identify and connect the headphones to the audio signal.

Preferably the plug types identified include one or more of the ARINC (Aeronautical Radio Incorporated) types as currently defined in the ARINC Specifications 628 Part 2.

Preferably the jack includes an appropriate plug socket for each plug pin, one or more of the sockets including detection means to detect the presence of a plug pin.

Preferably the jack includes three pin sockets.

Preferably the pin sockets are arranged in the form of a triangle.

Preferably two plug sockets are 3.5 mm diameter and are sockets capable of receiving stereo pins, and the third plug socket is a 2.5 mm socket capable of receiving at the least a 2.5 mm mono pin.

Preferably the jack is provided in a housing and the at least one moveable socket floats laterally within the housing.

To those skilled in the art to which the invention relates, many changes in constructions and widely different embodiments and applications of the invention will suggest themselves without departing from the scope of the invention as defined in the appended claims. The disclosure and descriptions herein are purely illustrative and are not intended to be in any sense limiting.

The invention consists of the foregoing and also envisages constructions of which the following gives examples only.

DESCRIPTION OF DRAWINGS

One presently preferred embodiment of the invention will now be described with reference to the accompanying drawings, wherein.

DETAILED DESCRIPTION OF THE INVENTION

The present invention overcomes the problem of different headset plugs being incompatible with headset jacks. As discussed above, the problem is particularly prevalent in the commercial airline industry where passengers in different "classes" may be issued with different headsets having different capabilities. Rather than having to change whole seat installations in order to change the jacks, the present invention allows a single multifunctional headphone jack to be used throughout an aircraft, bus or other passenger vehicle so that a number of different types of headset can be used.

The invention achieves this task by providing plug pin sockets that are arranged to allow each common headset type to be plugged into the jack, and by providing the jack system with passive or active detection means to detect, from the plug pins that have been inserted into the socket, the type of plug and thus the type of headset so that the required audio and other signals can be provided to the necessary plug conductors to enable the connected headset to function correctly. As mentioned above, the invention is particularly applicable to noise reduction headphone systems.

In order to fully understand the operation of the jack of the present invention, it is helpful it have a general understanding of headset types. Airline entertainment headphones have been categorised by ARINC into four different types, A, B, C and D. Types A and B are older types. Types C and D are intended for use with noise cancellation (NC) systems. Type C headphones incorporate NC electronics, and Type D are similar to type C except that the NC electronics is installed remotely in the seat area.

A summary table of airline entertainment system headphones is provided below.

TABLE 1

| HEADPHONE TYPE | IMPEDANCE Ohms | PLUG STYLE |
|---|---|---|
| A1 | 300 | Single prong, right angle |
| A2 | 300 | Dual prong, right angle |
| B1 | 40 | Single prong, right angle |
| B2 | 40 | Dual prong, right angle |
| C1 | High | Dual prong, right angle |
| C2 | High | Triple prong, right angle |
| D1 | 300 | Dual prong, right angle |
| D2 | 300 | Dual prong, right angle |

Further information can be found from the ARINC (Aeronautical Radio Incorporated) Specifications 628 Part 2, which is publicly available.

It is also helpful to have some understanding of headset types for noise cancellation systems. Existing and proposed headset types are set forth below.

Type 1

Figure 1A:
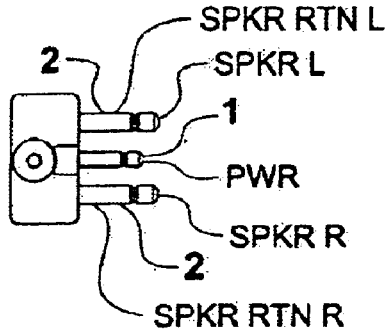
FIGS. 1A, 1B, and 1C are plan, front elevational, and side elevations, respectively, of a known three pin headset plug.
Figure 1B:
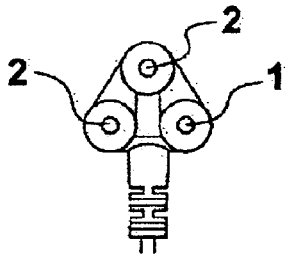
Figure 1C:
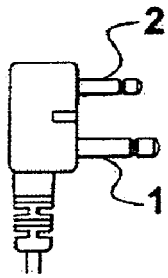

This headset has a three pin plug for which an associated three socket jack is required. This is usually installed into the armrest of the passenger seat. The plug is shown in FIGS. 1A–1C, having two 3.5 mm mono plug pins 1 and one 2.5 mono plug pin 2. It is commonly known as an ARINC "C2" plug, as will be described further below.

Figure 2:
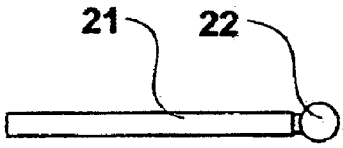
FIG. 2 is a diagrammatic elevation of a mono audio plug pin

A mono pin is shown in FIG. 2 in which it can be seen that the pin has two conductors, being a ring 21 and a tip 22.

Figure 3:
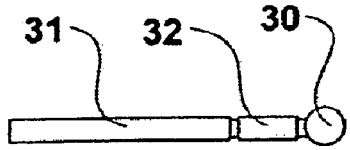
FIG. 3 is a diagrammatic elevation of a stereo audio plug pin

A stereo plug pin is shown in FIG. 3 from which it can be seen that the pin has three conductors, being a first ring 31, and second ring 32, and a tip 30.

Returning again to FIGS. 1A–1C, the 2.5 mm pin supplies power to the noise cancelling electronics located in or adjunct to the headset. The noise cancellation (NC) electronics typically connect to the jack with preferably a six-conductor cable. Two of these conductors are for power, one conductor for program audio left, one conductor for program audio right and two conductors for audio left ground and audio right ground. Therefore, the jack for this type of headset is one that is designed to accept mono plug pins, not stereo plug pins.

Between the NC circuit medallion and the headset's transducers are separate cables of two leads, each with four conductors. These provide program audio to the two speakers and noise signal from the two sensors. The sensor conductors are shielded.

Type 2

This is a variant of the Type 1 headset. The plug of this type of noise cancellation headset connects to a jack comprising a single 3.5 mm stereo socket and a 2.5 mm stereo socket. The headset is fed programme audio from the passenger seat remote jack unit via the 3.5 mm stereo sockets. Power is provided to the headset's NC circuit via the 2.5 mm stereo socket.

Type 3

This headset does not comprise any noise cancellation circuitry and relies on an audio signal that has already been processed to provide noise cancellation. Therefore, the NC circuitry is provided adjunct to the headphone, typically in the seat or within the remote jack unit itself. Control features on the headset may be provided. The control features do not include a noise cancellation circuit, but do include a volume control and an NC gain control. These may both be provided in the form of variable resistors. These control features do not alter the number of conduction paths required or the configuration of the sockets in the jack.

The cable from the jack to the headset or circuit is preferably seven-conductor assembly (two conductors for audio left and right, two audio grounds and two shielded cables for the sensor left and right).

Type 4

This is a variant of the Type 2 headset and is proposed at the present time. It is planned as a personal headset to be sold to passengers who wish to buy an NC headset for personal audio use. This model will have battery power for use with 32 ohm low voltage sources. The batteries will be located in the headset or adjunct to the headset in a box or medallion. Again, these requirements can be supplied using a plug according to the invention.

Figure 4:
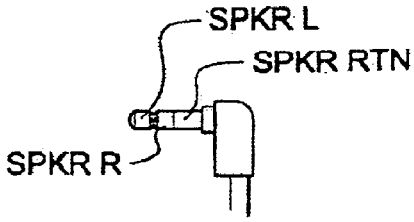
FIG. 4 shows a side elevation of a headset single stereo plug commonly referenced type A1 or B1.

As well as the noise cancellation headset types discussed above, it is desirable if the seat jack unit is provided with means to supply headsets, which are not noise cancellation headsets i.e. to supply simply mono or stereo audio without noise cancellation. Known jack arrangements for commercial aircraft are specified by ARINC (Aeronautical Radio Inc). FIG. 4 shows a standard airline single stereo plug, commonly referenced type A1 and type B1.

Figure 5:
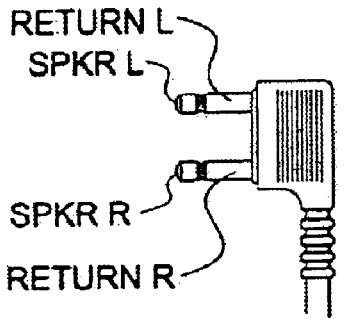
FIG. 5 shows a side elevation of a dual mono or dual stereo plug commonly referenced type A2 or B2.
Figure 6:
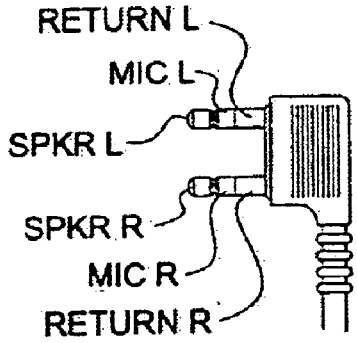
FIG. 6 shows a side elevation of a known audio plug usually referenced D2.

FIG. 5 shows a standard airline dual mono and dual stereo plug, commonly referenced type A2 and type B2. FIG. 6 shows a standard dual stereo type airline plug, which is usually, referenced D2.

Figure 7A:
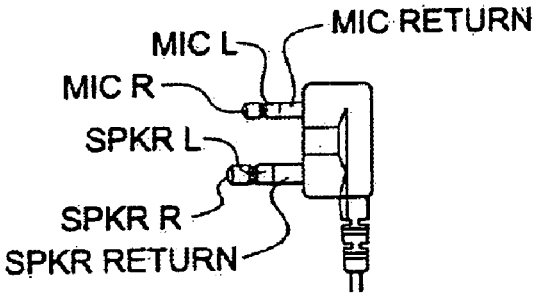
FIGS. 7A and 7B are a side elevation and end elevation, respectively, of a known plug having two pins commonly referenced type D1.
Figure 7B:
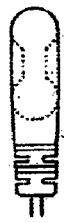
Figure 8A:
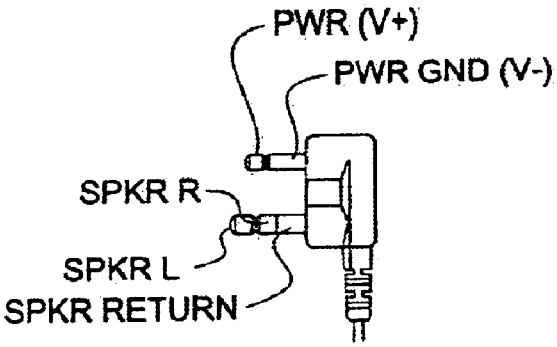
FIGS. 8A and 8B area side elevation and end elevation, respectively, of a plug having two pins commonly referenced type C1.
Figure 8B:
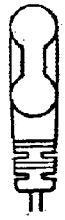

FIGS. 7A and 7B show an ARINC two pin plug, which is commonly called a type D1 plug.

A table, referenced table 2 below, shows the use for each of the conductors provided on the pins of the plug discussed above.

receive an ARINC two pin (D1) plug. Since two spaced 3.55 mm plug sockets are provided, the jack of the present invention enables existing dual mono and dual stereo plugs D2, A2 and B2 to be used. Also, a single stereo i.e. A1 or B1 plug can also be received.

Figure 9:
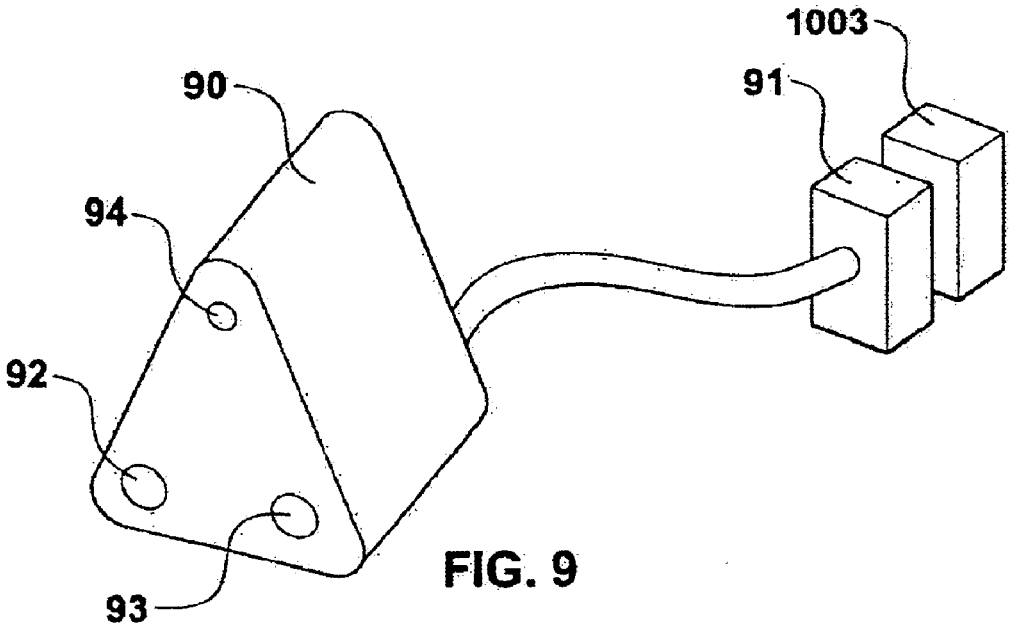
FIG. 9 shows an audio jack apparatus according to the present invention and FIG. 9A is a diagrammatic isometric view of a seat shown in broken lines and illustrating installation of the audio jack of FIG. 9.
Figure 9A:
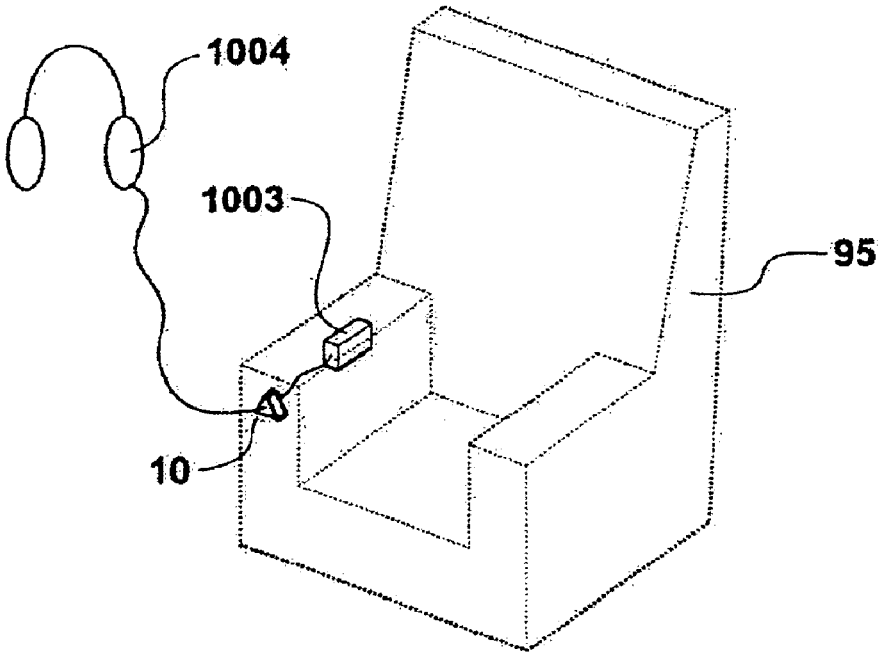

In FIG. 9A the audio jack 90 is shown installed in the armrest of a seat 95. The audio jack 90 is connected to an audio signal source and typically noise cancellation circuitry provided in the seat via connector 1003.

There is also a mechanical consideration. Due to slight differences in the construction of plugs and pins it is highly desirable to allow some movement in the jack assembly. Thus, in the preferred embodiment, one (preferably the 2.5 mm) or more of the jack sockets (or jacks) is allowed to "float" in the assembly. This is because the distance between the 2.5 mm pin and 3.5 mm pin in the C2 plug is slightly smaller (0.466 inches) than the D1, D2 plug (0.500 inches). The degree of tolerance for this dimension needs to be in the order of 0.05 inches on the angle from the axis of the 2.5 mm jack to the 3.5 mm jack. The tolerance is indicated in FIG. 9. Without this mechanical allowance the plug will be under strain and proper contact cannot be assured.

Referring again to table 1, it will be seen that in order to operate the different noise cancelling headsets referred to above, and standard headsets, which use the various plugs of table 1, appropriate connections need to be made from the "smart jack" of the present invention to the circuitry in the passenger seat or in the jack itself.

TABLE 2

| | SMART Jack | ARINC 3 pin (C2) | ARINC 2 pin (D1) | Dual Mono and Dual Stereo (D2, A2, B2) | Single Stereo (A1, B1) |
|---|---|---|---|---|---|
| 2.5 mm pin Tip | Control common | Power + | Ignored | Not present | Not present |
| 2.5 mm sleeve 1 | Control 1 | Power – | Ignored | Not present | Not present |
| 2.5 mm ring 2 | Optional | Not present | Ignored | Not present | Not present |
| 3.5 mm right tip | Program audio right | Program audio right | Program audio right | Program audio right | Program audio right |
| 3.5 mm right sleeve 1 | Noise sensor right | Program audio return right | Program audio left | Not present or right Noise sensor | Program audio left |
| 3.5 mm right ring 2 | Audio and noise return right | Not present same as ring 1 | Program audio return | Program audio right return | Program audio return |
| 3.5 mm left tip | Program audio left | Program audio left | Program audio left | Program audio left | Program audio left |
| 3.5 mm left sleeve 1 | Noise sensor left | Program audio left return | Program audio right | Not present or left Noise sensor | Program audio right |
| 3.5 mm left ring 2 | Audio and noise return left | Not present same as ring 1 | Program audio return | Program audio left return | Program audio return |

Also shown in table 1 is a column for the jack of the present invention, which is headed "smart jack". This column shows the use, which may be made of the conductors from the pin sockets in the multifunctional jack of the present invention.

Figure 10:
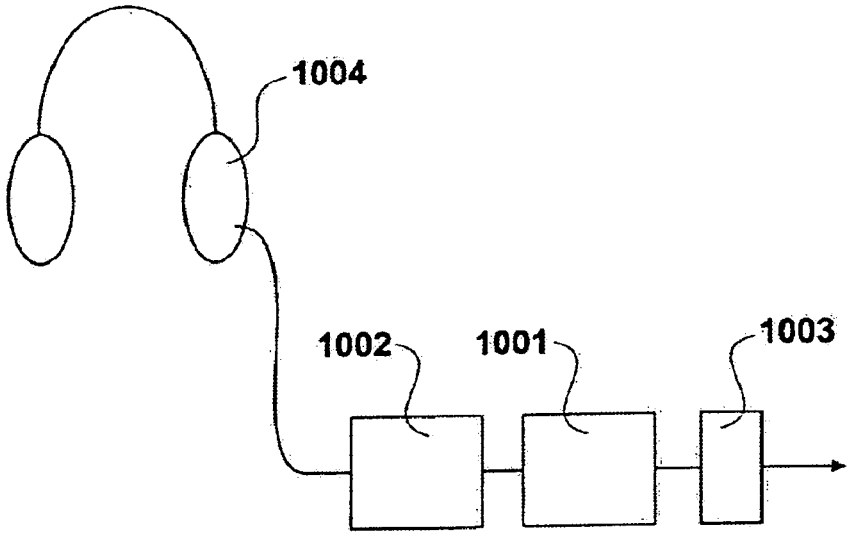
FIG. 10 shows a block diagram illustrating use of the audio jack of the present invention in a headset audio distribution system.

The jack of the present invention is shown in FIG. 9 generally referenced 90. As can be seen, it comprises two 3.5 mm plug sockets (92, 93) and a 2.5 mm plug socket 94 connected to a seat circuitry connector 91. The sockets are all capable of receiving pins, which have two or more conductors. This has the significant advantage that there is a maximum of nine possible conductors provided by the jack of the present invention. It will be seen that the plug sockets are arranged in a triangular form, which is compatible with that of the ARINC three pin triangular C2 plug. Furthermore, since a 2.5 mm socket is provided as well as a 3.5 mm socket, the jack of the present invention is able to Referring to FIG. 10, a block diagram is shown illustrating an interface 1001 which is provided between the smart jack 1002 and the audio signal provided to a seat connector 1003. The headset to which the jack is connected in use is referenced 1004.

The interface 1001, in the preferred embodiment, comprises an active or passive network which is either enabled by or partially consists of, sockets in the jack of the present invention which provide an indication as to whether a pin has been inserted in the relevant socket.

Figure 11:
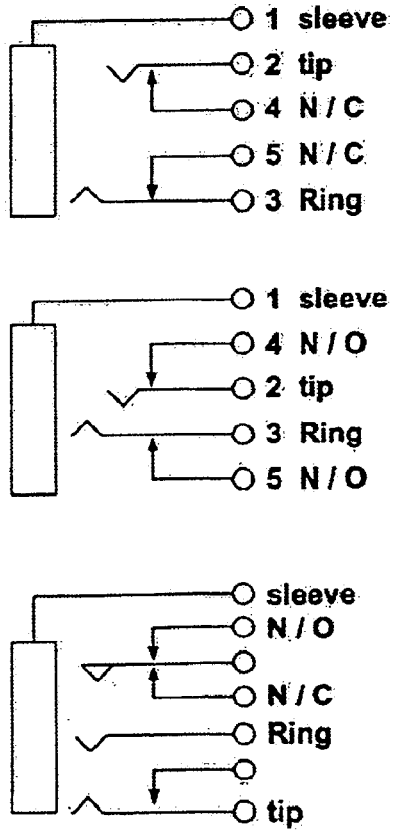
FIG. 11 shows electrical schematic diagrams for exemplary sockets according to the audio jack of the present invention.

In FIG. 11 examples of electrical schematic diagrams for a typical socket are shown. Each of the arrangements in FIG.

11 may be used to detect a plug pin type. As can be seen, the socket has electrical contacts, which enable up to three conductors on a plug pin to be electrically connected to the socket. In particular, the conductor at the tip of the pin can open or close a connection between the adjacent conductors. This means that a signal is provided as to whether a pin is fully inserted into a relevant socket. Therefore a logic table can be constructed to enable an identification to be made of the type of plug which has been inserted into the socket, and from that identification of the relevant headset can be made. Therefore, the appropriate connections from the audio signal provided in the seat to the headset can be made. Also, in the relevant instance, the appropriate connections can be made from noise cancellation circuitry provided in the seat to the relevant headset. By way of example, if only one of the 3.5 mm sockets and no other sockets register insertion of a pin, then it can be deduced that a single stereo plug has been inserted into the jack. If both the 3.5 mm plugs and not the 2.5 mm plug indicate that pins have been received in those sockets, then it can be deduced that the plug is of type A2 B2 or D2. Also from knowing whether there is a short between the conductors preceding the socket tip conductors, it will be know whether the pin that have been inserted are mono or stereo i.e. a distinction can be made between A2 and B2 and a D2 type plug.

Such deduction can also be carried out electronically by analysing the loading effect that a microphone would provide if connected in circuit to two of the conductors.

Figure 12:
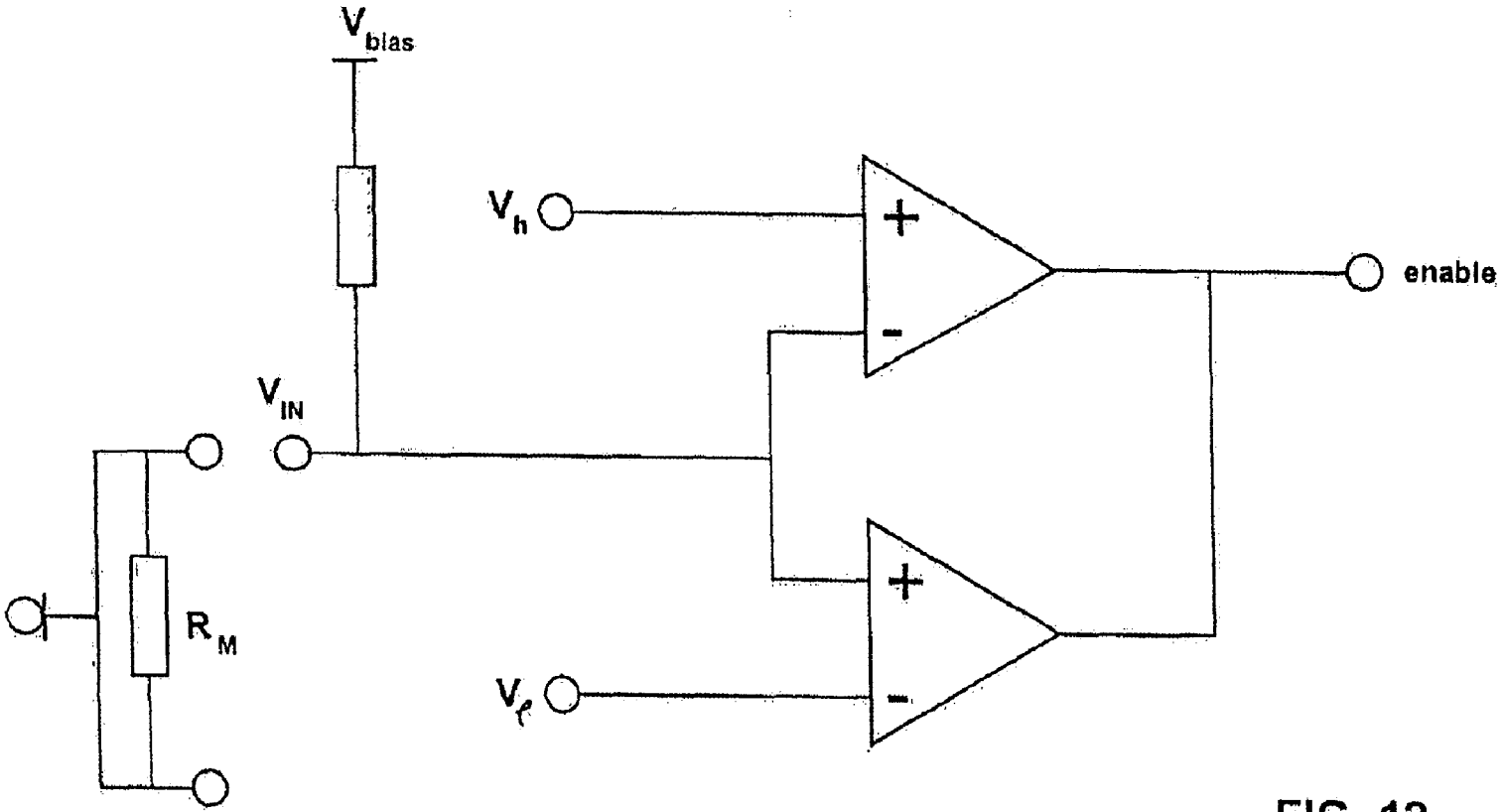
FIG. 12 shows a circuit of a comparator adapted to detect the presence of a microphone connected to a plug; and, FIG. 13 is a table illustrating plug configurations that may be used with the invention.

FIG. 12 illustrates such an approach with a voltage comparator where $$V_{bias}>V_h>V_{in}>V_l>V_e.$$

The window comparator detects whether the headset noise cancellation microphone dc voltage is within the range $V_h$ to $V_l$. A resitor in parallel to the microphone defines a minimum microphone load which, in conjunction with the pull up resistor, ensures that $V_h>V_{in}>V_l$ giving a high output form the comparator to enable noise cancellation circuitry.

If the microphone is disconnected then $V_{in}$ will equal $V_{bias}$ through the action of the pull up resistor and since $V_{bias}>V_h$ the enable output will be low. If the microphone input is grounded then $V_{in}<V_l$ and the enable output will also be low.

Figure 13:
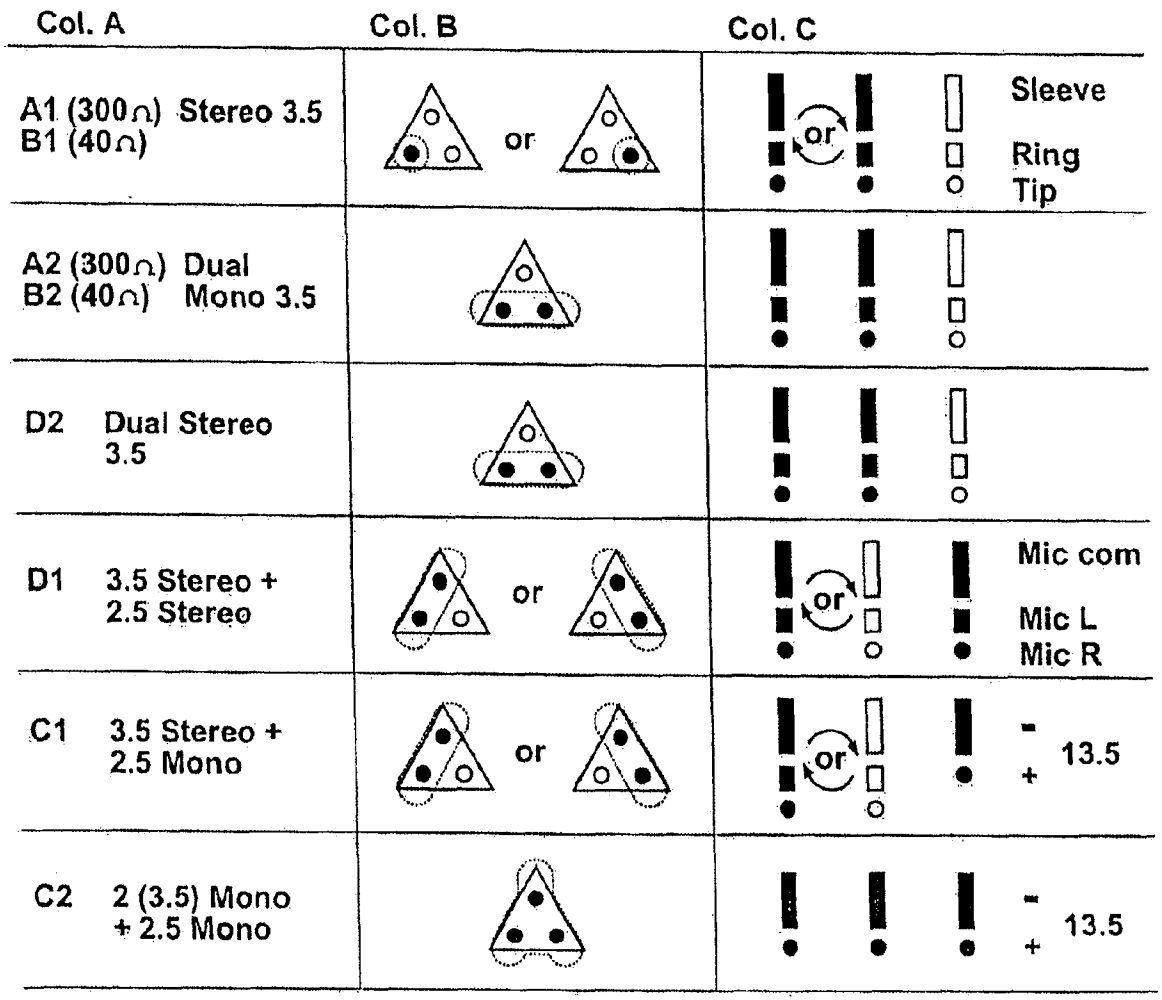

For additional understanding reference may be made to FIG. 13, which illustrates how the plug arrangements for type A, B, C and D headsets can all be accommodated by the invention. The plug pin layouts are graphically represented in column C. The pins shown in black in column C illustrate the sleeve/ring/tip conductors of the relevant plug pins used by the audio jack, and the white pins illustrate the unused plug pins. Column A describes the plug type, and column B diagrammatically shows the jack of the invention, with the plug type from column A overlaid in dashed outline.

Advantages of the Prefered Embodiments

From the foregoing, it will be seen that a multifunctional headset jack is provided which allows a number of different headset types to be plugged into the jack, and still perform their expected function, whether the headset is a NC headset or otherwise.

Typically the jack and associated sensing circuitry is intended to allow a user to plug in a headphone of any type from a single plug mono headphone, through to a triple plug noise cancelling type with either internal or external noise cancellation circuitry and still provide the expected result.

Manufacturing tolerances and minor specification differences in the headphone plugs where the plug is two or three pin may be coped with by the floating construction of one of the jack sockets.

Variations

The sensing circuitry may rely merely on detecting which of the jack sockets supplied have plugs entered by detecting which of the socket switches are closed or open, or it may additionally detect the presence of various impedances or supply voltages across certain of the plug tips, rings and sleeves.

While the sensing circuitry is described as being electronically implemented it is possible to implement it with either simple logic circuitry or with programmable software controlled circuitry which may be updateable remotely. This will allow an already installed system to cope with variations in headsets as the specifications for these change from time to time.

While the sensing circuitry is described in relation to headphones it is equally applicable to headsets containing headphones and microphone.

Finally various other alterations or modification may be made to the foregoing without departing from the scope of this invention.

What is claimed is:

1. Audio jack apparatus for a noise cancellation system, the apparatus comprising:

an audio jack for receiving one of a plurality of different headset plugs, each plug having one or more pins with at least one conducting element, the audio jack having three pin receiving sockets, the pin receiving sockets being arranged in the form of a triangle, two of the pin receiving sockets each being capable of making electrical connections with the conducting elements of receiving plug pins having at least three conducting elements and the third pin receiving socket being capable of making electrical connections with the conducting elements of a pin having at least two conducting elements, and an identification circuit associated with the audio jack, the identification circuit being capable of making appropriate connections between the audio jack and an audio signal source dependent on the plug pin configuration of a headset plug or an electrical characteristic of a headset.

2. The audio jack apparatus of claim 1 wherein the identification circuit is also capable of detecting whether the headset is required to be connected to a noise cancellation circuit.

3. The audio jack apparatus of claim 2 wherein the identification circuit connects the headset to the noise cancellation circuit after detecting that that the headset is required to be connected to the noise cancellation circuit.

4. The audio jack apparatus of claim 2 wherein the identification circuit detects whether the headset is required to be connected to a noise cancellation circuit by electrically detecting whether a microphone is provided as part of the headset.

5. The audio jack apparatus of claim 1 wherein the identification circuit is capable of detecting whether the headset requires a power supply and providing the required power supply.

6. The audio jack apparatus of claim 1 wherein the third receiving socket is capable of making electrical connections with the conducting elements of a pin having three conducting elements.

7. The audio jack apparatus of claim 1 wherein the plurality of headset plugs includes at least one plug of a headset that is not for use with a noise cancellation system.

8. The audio jack apparatus of claim 1 wherein the plurality of headset plugs includes at least one ARINC type.

9. The audio jack apparatus of claim 1 wherein the third pin receiving socket comprises a 2.5 mm mono pin socket, and the other two pin receiving sockets comprise 3.5 mm stereo pin sockets.

10. The audio jack apparatus of claim 1 wherein the audio jack is provided in a housing and at least one of the sockets is laterally moveable relative to the housing.

11. A passenger seat of a vehicle comprising:

an audio jack, the audio jack being adapted to receive one of a plurality of different headset plugs, each plug having one or more pins with at least one conducting element, the audio jack having three pin receiving sockets, the pin receiving sockets being arranged in the form of a triangle, two of the pin receiving sockets each being capable of making electrical connections with the conducting elements of receiving plug pins having at least three conducting elements and the third pin receiving socket being capable of making electrical connections with the conducting elements of a pin having at least two conducting elements;

an audio signal source; and, an identification circuit associated with the audio jack, the identification circuit being capable of making appropriate connections between the audio jack and the audio signal source dependent on the plug pin configuration of the headset plug or an electrical characteristic of the headset.

12. The passenger seat of claim 11 including a noise cancellation circuit, and the identification circuit being capable of detecting whether the headset is required to be connected to the noise cancellation circuit.

13. The passenger seat of claim 12 wherein the identification circuit connects the headset to the noise cancellation circuit after detecting that that the headset is required to be connected to the noise cancellation circuit.

14. The passenger seat of claim 11 wherein the passenger seat is an aircraft seat.

15. A passenger aviation audio system comprising:

an audio jack, the audio jack being adapted to receive one of a plurality of different headset plugs, each plug having one or more pins with at least one conducting element, the audio jack having three pin receiving sockets, the pin receiving sockets being arranged in the form of a triangle, two of the pin receiving sockets each being capable of making electrical connections with the conducting elements of receiving plug pins having at least three conducting elements and the third pin receiving socket being capable of making electrical connections with the conducting elements of a pin having at least two conducting elements;

an audio signal source;

a noise cancellation circuit; and, an identification circuit associated with the audio jack, the identification circuit being capable of making appropriate connections between the audio jack and the audio signal source and between the audio jack and the noise cancellation circuit dependent on the plug pin configuration of the headset plug or an electrical characteristic of the headset.

16. The passenger aviation audio system of claim 15 wherein the identification circuit detects whether the headset is required to be connected to the noise cancellation circuit by electrically detecting whether a microphone is provided as part of the headset.

17. The passenger aviation audio system of claim 15 wherein the identification circuit is capable of detecting whether the headset requires a power supply and providing the required power supply.

18. The passenger aviation audio system of claim 15 wherein the third receiving socket is capable of making electrical connections with the conducting elements of a pin having three conducting elements.

19. The passenger aviation audio system of claim 15 wherein the plurality of headset plugs includes at least one plug of a headset that is not for use with a noise cancellation system.

20. The passenger aviation audio system of claim 15 wherein the plurality of headset plugs includes at least one ARINC type.

21. The passenger aviation audio system of claim 15 wherein the third pin receiving socket comprises a 2.5 mm mono pin socket, and the other two pin receiving sockets comprise 3.5 mm stereo pin sockets.

22. The passenger aviation audio system of claim 15 wherein the audio jack is provided in a housing and at least one of the sockets is laterally moveable relative to the housing.

* * * * *